US010390582B2

(12) United States Patent
Copeland et al.

(10) Patent No.: US 10,390,582 B2
(45) **Date of Patent: *Aug. 27, 2019**

(54) PROTECTIVE HEADGEAR

(71) Applicant: TWO GUYS AND A HAT INC., Barrie (CA)

(72) Inventors: Steve A. Copeland, Barrie (CA); Len Clement, Palgrave (CA); Mitch Thompson, Barrie (CA)

(73) Assignee: TWO GUYS AND A HAT INC., Barrie, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/634,526

(22) Filed: Jun. 27, 2017

(65) Prior Publication Data

US 2017/0290389 A1 Oct. 12, 2017

Related U.S. Application Data

(63) Continuation-in-part of application No. 14/919,001, filed on Oct. 21, 2015, now Pat. No. 10,004,290.
(Continued)

(51) Int. Cl.
*A42B 1/20* (2006.01)
*A42B 3/32* (2006.01)
(Continued)

(52) U.S. Cl.
CPC ..... *A42B 3/32* (2013.01); *A42B 1/02* (2013.01); *A42B 1/22* (2013.01); *A42B 3/0406* (2013.01); *A42B 3/227* (2013.01)

(58) Field of Classification Search
CPC .... A42B 1/08; A42B 3/00; A42B 3/10; A42B 3/12; A42B 3/125; A42B 3/06;
(Continued)

(56) References Cited

U.S. PATENT DOCUMENTS 1,378,977 A 5/1921 Parmley
1,852,930 A 4/1932 Hoppe
(Continued)

FOREIGN PATENT DOCUMENTS

| | | |
|---|---|---|
| DE | 19518961 | 11/1996 |
| GB | 883137 | 11/1961 |
| JP | 3149676 | 4/2009 |

OTHER PUBLICATIONS

Unpublished Patent Application entitled Riding Helmet With Variable Thickness Impact Absorbing Material Providing Improved Appearance, filed Aug. 24, 2015, listing Ronald S. Friedson as the inventor.

*Primary Examiner* — Robert H Muromoto, Jr.
(74) *Attorney, Agent, or Firm* — Sand, Sebolt & Wernow Co., LPA

(57) ABSTRACT

A protective headgear for equestrian use provides a traditional style cowboy hat with protective features to allow it to comply with prevailing equestrian helmet standards. The hat includes interior protective padding in the top of the dome, exterior protective padding below the crown of the dome, and exterior protective padding on the rear of the hat below the brim. The protective padding may be secured to the hat by adhesive, stitching, or mechanical fasteners. A chin strap securement system comprising mutually connectable strap-and-buckle assemblies is optionally provided.

6 Claims, 12 Drawing Sheets

Related U.S. Application Data

(60) Provisional application No. 62/087,967, filed on Dec. 5, 2014.

(51) Int. Cl.

| | |
|---|---|
| ***A42B 1/02*** | (2006.01) |
| ***A42B 1/22*** | (2006.01) |
| ***A42B 3/04*** | (2006.01) |
| ***A42B 3/22*** | (2006.01) |
| *A42B 1/00* | (2006.01) |

(58) Field of Classification Search

CPC .. A42B 3/127; A42B 1/02; A42B 1/06; A42B 1/061; A42B 1/068; A42B 1/069; A42B 1/205; A63B 71/10; A41D 13/015; A41D 13/0012

See application file for complete search history.

(56) References Cited

U.S. PATENT DOCUMENTS 1,894,213 A 1/1933 Ostolaza
2,143,483 A 1/1939 Iglauer
2,437,748 A 3/1948 Malcom
2,442,052 A 5/1948 Mauro
2,511,234 A 6/1950 Anderson
2,698,434 A 1/1955 Davia
2,717,384 A 9/1955 Frothingham
2,781,517 A 2/1957 Fisher
2,794,189 A 6/1957 Nesbit et al.
2,796,680 A 6/1957 Wittcoff
2,861,270 A 11/1958 McCoy
2,893,014 A 7/1959 Mabry
2,926,406 A 3/1960 Zahnor
3,103,015 A 9/1963 Plastino
3,329,968 A 4/1965 Gordon
3,214,809 A 11/1965 Zahnor
3,286,275 A 11/1966 Marchello
3,325,824 A 6/1967 Donegan
3,696,440 A 10/1972 Littleton
4,439,871 A 4/1984 Plastino
4,581,773 A 4/1986 Cunnane
4,619,003 A 10/1986 Asbury
4,942,628 A 7/1990 Freund
5,226,180 A 7/1993 Leach
5,331,687 A 7/1994 Kronenberger
5,437,064 A 8/1995 Hamaguchi
5,511,250 A 4/1996 Field
5,519,895 A 5/1996 Barnes, Jr.
5,571,217 A 11/1996 Del Bon
5,713,083 A 2/1998 King
5,718,004 A 2/1998 Broersma et al.
5,815,847 A 10/1998 Holden
5,826,278 A 10/1998 King
5,845,341 A 12/1998 Barthold
5,867,840 A 2/1999 Hirosawa et al.
5,887,289 A 3/1999 Theoret
5,893,174 A 4/1999 Primeau
5,950,245 A 9/1999 Binduga
5,960,652 A 10/1999 Marmstad
6,032,297 A 3/2000 Barthold
6,108,824 A 8/2000 Fournier
6,154,889 A 12/2000 Moore, III
6,240,570 B1 6/2001 Wu
6,256,798 B1 7/2001 Egolf
6,260,204 B1 7/2001 Morrissey
6,266,827 B1 7/2001 Lampe et al.
6,314,588 B1 11/2001 Fang
6,360,376 B1 3/2002 Carrington
6,374,423 B1 4/2002 Anderson et al.
6,453,476 B1 9/2002 Moore, III
6,647,556 B2 11/2003 Grepper
6,708,376 B1 3/2004 Landry
6,865,752 B2 3/2005 Udelhofen
6,868,560 B2 3/2005 Bostock
6,880,176 B2 4/2005 Timms et al.
6,966,074 B2 11/2005 Huh
6,983,488 B2 1/2006 Foote et al.
7,000,262 B2 2/2006 Bielefeld
7,043,772 B2 5/2006 Bielefeld
7,096,512 B2 8/2006 Blair
7,103,923 B2 9/2006 Picotte
7,114,194 B2 10/2006 English
7,174,575 B1 2/2007 Scherer
D538,513 S 3/2007 Serratelli
7,222,374 B2 5/2007 Musal
7,406,721 B2 8/2008 Husbands et al.
7,565,704 B2 7/2009 Wu
D604,930 S 12/2009 Denny
D637,378 S 5/2011 Cornwell
7,966,673 B1 6/2011 Gibson
3,056,150 A1 11/2011 Stokes
8,060,951 B2 11/2011 Smith
3,161,576 A1 4/2012 Lemke
8,205,272 B2 6/2012 Green et al.
8,370,967 B2 2/2013 Chen
3,434,200 A1 5/2013 Chen
8,453,269 B2 6/2013 Hampton, II
8,613,114 B1 12/2013 Olivares Velasco
8,763,166 B1 7/2014 Olivares Velasco
8,776,273 B2 7/2014 Krause
8,832,869 B2 9/2014 Ma
8,875,318 B2 11/2014 Huh
8,978,167 B2 3/2015 Blair
8,997,265 B2 4/2015 Olivares Velasco
9,021,616 B2 5/2015 Baty
9,149,085 B2 10/2015 Bryan et al.
D749,307 S 2/2016 Denny
D752,824 S 3/2016 Vito et al.
D768,966 S 10/2016 Denny
9,551,405 B1 1/2017 Chen
2004/0226078 A1 11/2004 Lahman et al.
2007/0000025 A1 1/2007 Picotte
2007/0130673 A1 6/2007 Wasserkrug et al.
2007/0157372 A1 7/2007 Musal
2007/0220663 A1 9/2007 Picotte
2007/0266481 A1 11/2007 Alexander
2008/0060117 A1 3/2008 Timms
2008/0083053 A1 4/2008 Lin
2008/0092276 A1 4/2008 Chiang
2008/0092279 A1 4/2008 Chiang
2008/0109947 A1 5/2008 Dubois
2008/0276354 A1 11/2008 Stokes
2010/0050325 A1 3/2010 Wang-Lee
2010/0095438 A1 4/2010 Moelker
2010/0170068 A1 7/2010 Musal
2010/0281604 A1 11/2010 Grim
2011/0264021 A1* 10/2011 Hettich ..... A41B 11/14 601/151
2011/0265254 A1 11/2011 Ma
2011/0302697 A1 12/2011 Jaquez et al.
2011/0307997 A1 12/2011 Blair
2012/0012628 A1* 1/2012 Just ..... A45C 13/02 224/578
2012/0124718 A1 5/2012 Picotte
2012/0131731 A1 5/2012 Motroni
2012/0144565 A1 6/2012 Huh
2013/0014359 A1 1/2013 Chen
2013/0031701 A1 2/2013 Krauter
2013/0047323 A1 2/2013 Ireland
2013/0205478 A1 8/2013 Pfanner
2014/0207034 A1* 7/2014 Hettich ..... A41B 11/14 601/84
2014/0213948 A1* 7/2014 Romo ..... A61F 5/0123 602/16
2014/0300157 A1* 10/2014 Halliday ..... A47C 7/46 297/284.3
2014/0336554 A1* 11/2014 Romo ..... A61F 5/0125 602/16
2015/0005685 A1* 1/2015 Chetlapalli ..... A61F 5/0125 602/16
2015/0089725 A1 4/2015 Lowe et al.

(56) References Cited

U.S. PATENT DOCUMENTS

| | | | | |
|---|---|---|---|---|
| 2015/0143621 | A1* | 5/2015 | Conolly ..... | A63B 21/00181 2/467 |
| 2015/0237944 | A1 | 8/2015 | Floyd, Jr. et al. | |
| 2015/0305428 | A1 | 10/2015 | Lakes | |
| 2016/0015104 | A1 | 1/2016 | Edwards et al. | |
| 2016/0015112 | A1 | 1/2016 | Bryan et al. | |

* cited by examiner

PROTECTIVE HEADGEAR

CROSS REFERENCE TO RELATED APPLICATIONS

This application is a continuation-in-part application of U.S. patent application Ser. No. 14/919,001, filed on Oct. 21, 2015, which claims the benefit of U.S. Provisional Patent Application Ser. No. 62/087,967, filed on Dec. 5, 2014; the disclosures of which are entirely incorporated herein by reference.

BACKGROUND

Technical Field

The present disclosure relates generally to protective headgear. More particularly, to improved headgear for equestrian use. Specifically, the present disclosure relates to a protective headgear having the profile of a cowboy hat and the protective functionality of an equestrian helmet.

Background Information

Headgear or helmets are becoming increasingly prevalent in equestrian riding. There is evidence that the use of ASTM/SEI certified helmets save lives and reduce injuries. Many equestrian organizations require the use of helmets. The States of Florida and New York have passed legislation requiring the wearing of helmets for riding. In 2009, the State of Florida mandated helmets for youths under the age of 16. New York has had helmet laws affecting youths under the age of 14 since 1999. The United States Equestrian Foundation (USEF) requires that in classes that mandate a helmet to be worn, that helmet must be ASTM/SEI certified.

However, these helmets are typically the English style that is shunned by Western style riders. The iconic look, fit, and practical sun and rain protection offered by the American cowboy hat still permeates the culture of Western riders. It is common for children to wear these English style helmets while under the supervision of their parents and guardians. As their age, skill, and independence increases, the Western style riders become more concerned with style and emulating the Western rodeo riders who continue to wear a traditional cowboy hat. They abandon their helmets and wear cowboy hats, disregarding their safety and lives, just to maintain this Western tradition.

The cowboy hat, or "western-style hat," is a high-crowned, wide brimmed hat best known as the defining piece of attire for the North American cowboy. Today's cowboy hat has remained basically unchanged in construction and design since the first one was created in 1865 by J. B. Stetson. It is worn by many people and is particularly associated with ranch workers in the Western and Southern United States, Western Canada, and Northern Mexico. It is also popular among country-western singers and North American rodeo participants. It is recognized around the world as part of Old West lore. The shape of a cowboy hat's crown and brim are often modified by the wearer for fashion and to offer better protection against the elements. It is an item of apparel that can be worn in any corner of the world and receive immediate recognition as part of North American cowboy culture.

There have been a few attempts to make a cowboy hat to fit over an equestrian helmet. Troxel, introduced the Western Hat Helmet in 2008. Through the development process, Troxel learned that the helmet portion of the Western hat system could not be made substantially thinner nor smaller and still pass ASTM/SEI certification, even with the most advanced and innovative materials available. This posed a significant challenge as the thickness of the helmet caused the Western hat to look significantly larger when compared to a traditional cowboy hat. As a result, the Western Hat Helmet was not accepted by the equestrian market and has since been discontinued.

One other attempt to provide a western inspired riding helmet is identified in U.S. patent application Ser. No. 14/833,826, filed on Aug. 25, 2015 Aug. 24, 2015, and claiming the benefit of U.S. Provisional Application Ser. No. 62/041,244, filed on Aug. 25, 2014, entitled "RIDING HELMET WITH VARIABLE THICKNESS IMPACT ABSORBING MATERIAL PROVIDING IMPROVED APPEARANCE". The application provides a riding helmet having variable thicknesses impact absorbing material providing improved aesthetics with more natural proportions while providing required impact protection. The front and rear of a riding helmet have an interior impact absorbing material that is thicker than an interior impact absorbing material of the opposing sides. Additional impact absorbing material is placed exteriorly on the opposing sides of the riding helmet to provide additional impact protection. In another embodiment, the brim of the riding helmet provides additional impact protection. The exterior impact absorbing material provides impact protection while maintaining the aesthetics and proportions of a riding helmet, and especially a Western style riding helmet. More particularly, the application has an internal protective member entirely within a dome portion of a hardened outer protective shell. The application includes small protective members, or concha, located exterior the protective shell in spaced apartment increments and sometimes attached to a hat band.

One disadvantage apparent in the application is that the outer protective shell resembling a hat (but remarkably is not a regular western hat) is larger than a traditional western-style hat. For example, the entire shell of the application has to be enlarged to provide sufficient coverage for the internal protective member. Notably, the internal protective member varies in thickness at certain locations relative to the wearer's head. For example, the thickness of the internal protective member is thicker at the front and rear portion of the shell and thinner at the left and right side of the shell.

One exemplary need that exists to solve the short-comings of the application is that riders want to wear a regular store-bought conventional cowboy hat. Riders want to outfit/convert a store-bought hat into a helmet or piece of protective headgear that can provide sufficient protection and meet ASTM/SEI safety standards.

SUMMARY

The foregoing issues are resolved and an advance in the art is achieved by providing a traditional style cowboy, or western-style, hat with protective features to allow it to pass the ASTM/SEI equestrian helmet standard. In one embodiment, the helmet includes interior protective padding in the top of the dome, exterior protective padding below the crown of the dome, and exterior protective padding on the rear of the hat below the brim. The protective padding may be secured to the hat by adhesive, stitching, or mechanical fastener.

In one aspect, an embodiment of the present disclosure may provide a protective headgear comprising: a hat including a domed portion having an inner surface and an opposed outer surface extending upwardly from a brim; an exterior first protective member exterior the outer surface; an interior second protective member interior the inner surface; and wherein the hat is a cowboy hat.

In another aspect, an embodiment of the present disclosure may provide a protective headgear comprising: a western-style cowboy hat having a 360° brim and an upper dome extending upwardly from the brim; wherein the upper dome is formed from a protective padding; and a shell exterior to the upper dome entirely surrounding the dome.

In another aspect, an embodiment of the present disclosure may provide a method of donning protective headgear comprising the steps of: placing a protective headgear atop a wearer's head, the protective headgear including an external first protective member exterior to a vertically extending sidewall and an interior second protective member interior to the sidewall; and shading all sides of the wearer with a 360° brim extending outwardly from the sidewall. Additionally, this method may include the step of connecting a buckle on strap assembly beneath the wearer's chin, wherein an upper forward end of the strap assembly is coupled adjacent the sidewall and an upper rear end of the strap assembly is couple to a third protective member extending downwardly from the brim.

In yet another aspect, an embodiment of the present disclosure may provide a protective headgear for equestrian use having a traditional style cowboy hat with protective features to allow it to comply with prevailing equestrian helmet standards. The hat includes interior protective padding in the top of the dome, exterior protective padding below the crown of the dome, and exterior protective padding on the rear of the hat below the brim. The protective padding may be secured to the hat by adhesive, stitching, or mechanical fasteners. A chin strap securement system comprising mutually connectable strap-and-buckle assemblies may be optionally provided.

In yet another aspect, an embodiment of the present disclosure may provide a method for converting a full brim hat into protective headgear comprising the steps of providing a full brim hat having a dome extending upwardly from the full brim inserting an internal protective member interior the dome and disposing an annular external protective member exterior the dome above the full brim.

In yet another aspect, an embodiment of the present disclosure may provide a protective headgear kit for converting a full brim hat into protective headgear comprising a full brim hat having a dome extending upwardly from the full brim, an internal protective member interior the dome having a bottom, and an annular external protective member exterior and completely circumscribing the dome above the brim and a portion of the external protective member below the bottom of the internal protective member.

In yet another aspect, an embodiment of the present disclosure may provide a protective headgear device comprising: a hat including a domed portion and a brim; a first protective member exterior to the domed portion; at least one anchor carried by the first protective member; and at least one connector connected with the at least one anchor and extending through the brim. This embodiment or another embodiment may further provide a bottom surface of the first protective member positioned above an upper surface of the brim. This embodiment or another embodiment may further provide a first arm on the anchor for embedding the anchor in the first protective member. This embodiment or another embodiment may further provide an enlarged head on the connector; and a pair of opposing flexible flanges inside the anchor defining a one-way connection when the enlarged head is inserted therein. This embodiment or another embodiment may further provide a strap including an end coupled with the connector. This embodiment or another embodiment may further provide a rear protective member separate and distinct from the first protective member positioned generally below the brim. This embodiment or another embodiment may further provide, wherein the rear protective member defines the at least one connector that extends through the brim. This embodiment or another embodiment may further provide a foam layer and an outer layer positioned rearward from the impact-protecting foam layer. This embodiment or another embodiment may further provide a cushion layer positioned forwardly from the foam layer. This embodiment or another embodiment may further provide an adjustment mechanism inside the domed portion of the hat adapted to change a circumference associated with the hat to accommodate a variety of different sized wearer's heads. This embodiment or another embodiment may further provide a hat band, wherein a first portion of the adjustment mechanism is radially interior to the hat band and a second portion of the adjustment mechanism is radially exterior to the hat band relative to a vertical centerline. This embodiment or another embodiment may further provide a pin extending through the hat band connected the first portion of the adjustment mechanism to the second portion of the adjustment mechanism. This embodiment or another embodiment may further provide a wheel rotatable about an axis, wherein the circumference of the adjustment mechanism varies in response to rotation of the wheel. This embodiment or another embodiment may further provide wherein the adjustment mechanism further comprises: a housing; a first rear strap and a second rear strap, wherein the first and second rear straps extend through the housing and are in operative communication with the wheel.

In yet another aspect, an embodiment of the present disclosure may provide an adjustment mechanism for headgear comprising: a forward portion having a first end and a second end adapted to partially circumscribe a forward portion of a wearer's head; a first rear strap adapted to partially circumscribe a rear portion of a wearer's head; a second rear strap to partially circumscribe a rear portion of a wearer's head opposite the first rear strap; the first end of the forward portion connected to the first rear strap at a first union, wherein the first end of the forward portion and the first rear strap are positioned on opposite sides of an intermediate layer at the first union; and the second end of the forward portion connected to the second rear strap at a second union, wherein the second end of the forward portion and the second rear strap are positioned on opposite sides of the intermediate layer at the second union. This embodiment or another embodiment may further provide wherein the intermediate layer is a hat band. This embodiment or another embodiment may further provide a rotatable wheel configured to move the first and second rear straps in response to rotation of the wheel; wherein the forward portion is positioned between the hat band and a domed hat. This embodiment or another embodiment may further provide wherein the first rear strap and the second rear strap are positioned interior to the hat band, and further comprising: a first connector extending through the hat band connecting the first rear strap to a first end of the forward portion; and a second connector extending through the hat band connecting the second rear strap to a second end of the forward portion. This embodiment or another embodiment may further provide wherein the adjustment mechanism includes no straps that extend upwardly over a region adapted to receive a crown of the wearer's head.

In yet another aspect, an embodiment of the present disclosure may provide an adjustable headgear device comprising: a full brim simulating a western-style cowboy hat; a domed portion extending upwardly from the full brim, the domed portion having a bottom edge defining a circumference, the domed portion adapted to receive a wearer's head; a hat band interior to the domed portion near the bottom edge, the hat band extending around at least a majority of the circumference of the bottom edge; an adjustment mechanism including a forward portion, a first rear strap, a second rear strap, and a rotatable wheel configured to move the first and second rear straps in response to rotation of the wheel; wherein the forward portion is positioned between the hat band and the domed portion; wherein the first rear strap and the second rear strap are positioned interior to the hat band; a first pin extending through the hat band connecting the first rear strap to a first end of the forward portion; a second pin extending through the hat band connecting the second rear strap to a second end of the forward portion; a first protective member exterior to the domed portion, wherein the protective member is annularly shaped and fully circumscribes the domed portion; a second protective member interior to the domed portion positioned above the hat band and the adjustment mechanism; a third protective member extending downwardly from the full brim; and a strap assembly connected to the first protective member via anchors embedded in the first protective member, wherein a portion of the strap assembly extends through the full brim.

BRIEF DESCRIPTION OF THE SEVERAL VIEWS OF THE DRAWINGS

A sample embodiment of the present disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the present disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
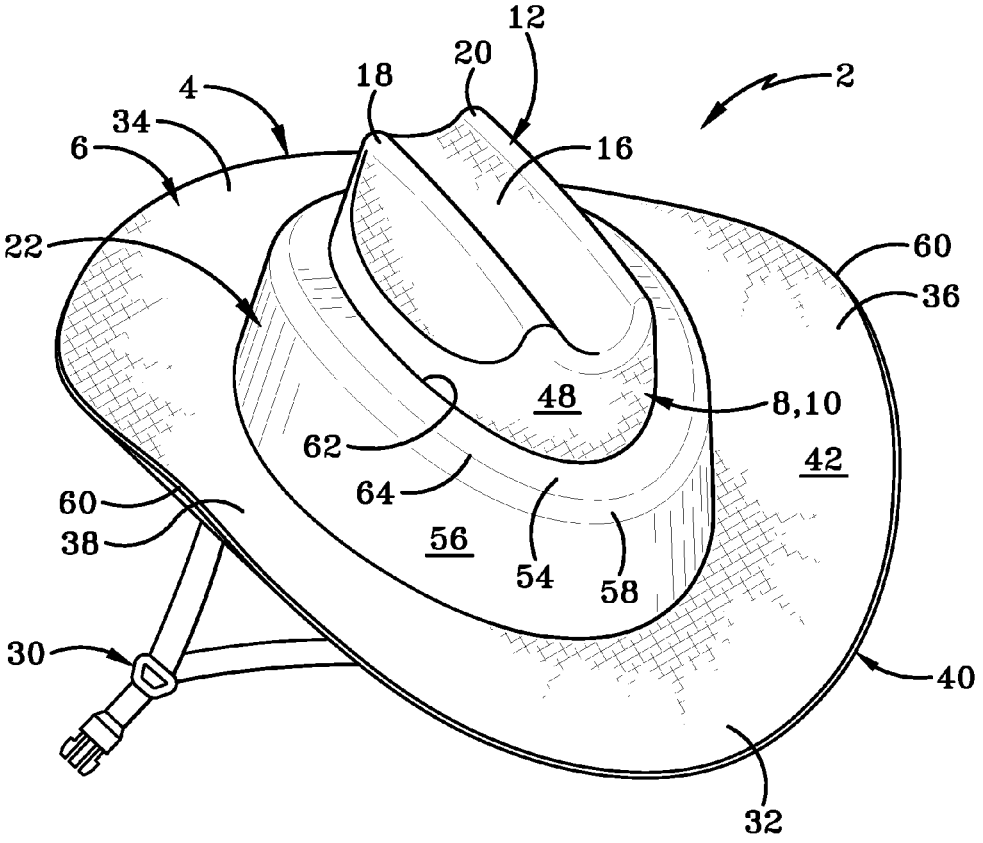
FIG. 1 is a top perspective view of a first embodiment of protective headgear.

The protective headgear of the present disclosure is generally depicted throughout the figures and is indicated generally as 2. The protective headgear 2 includes a hat member 4, a lower brim 6, a dome 8, a sidewall 10, a crown 12, an uppermost U-shaped portion 16, a first convex connector portion 18, a second convex connector portion 20, external first protective padding member 22, internal second protective padding member 24 (FIG. 2), a rear third protective padding member 26 (FIG. 2), a head band 28, and a strap and buckle assembly 30.

Figure 2:
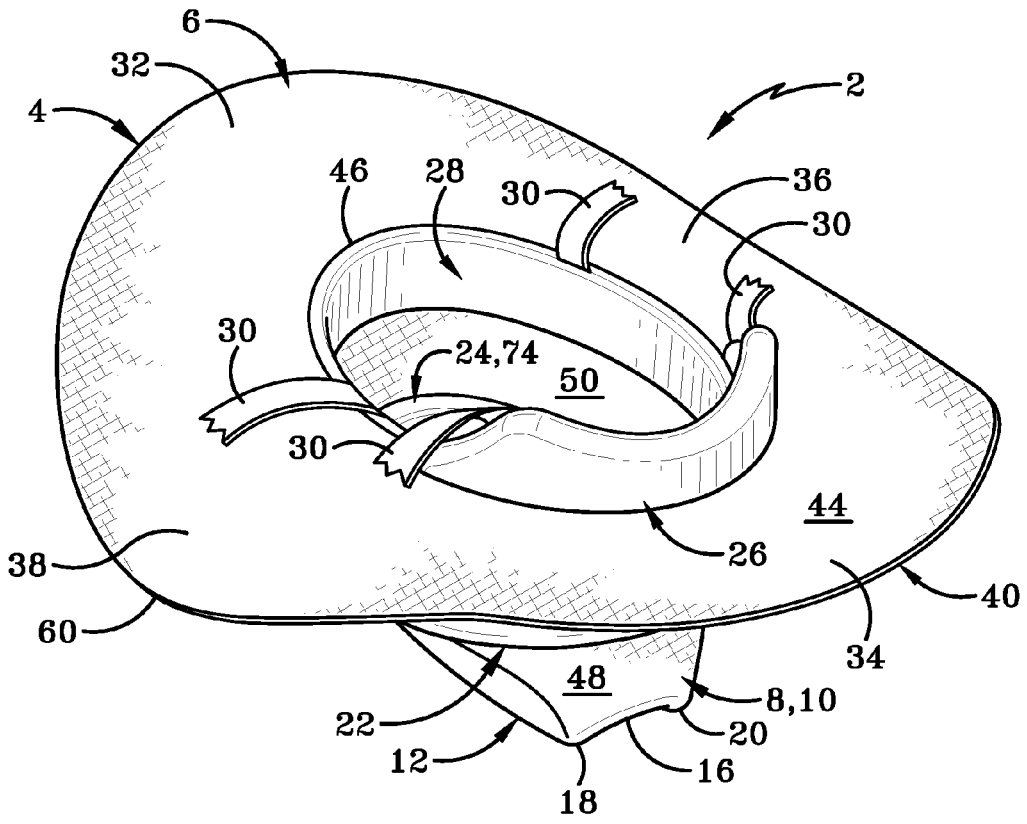
FIG. 2 is a bottom perspective view of the first embodiment.
Figure 3:
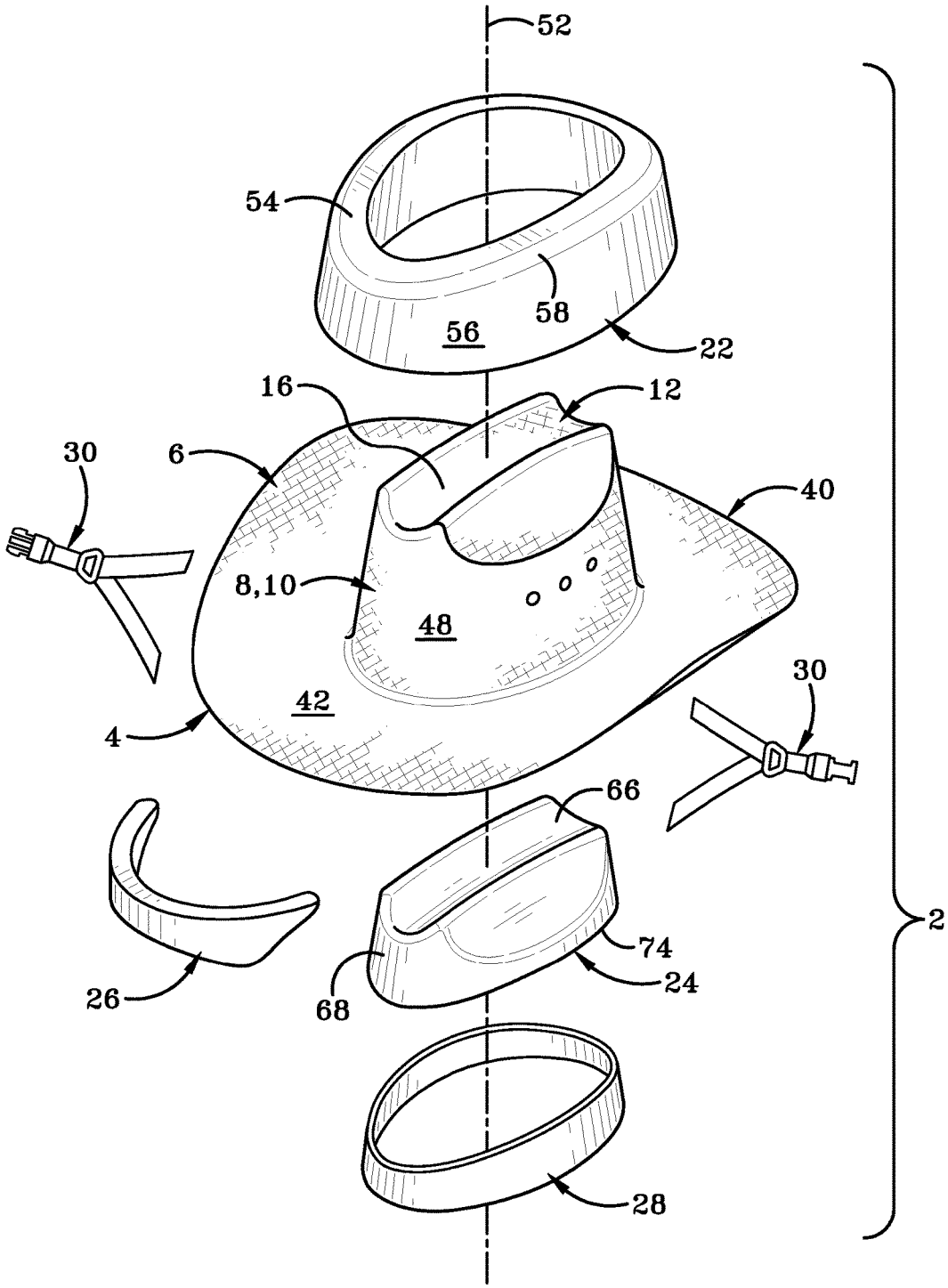
FIG. 3 is an exploded perspective view of the first embodiment.

Turning now to the drawings wherein like reference numerals indicate like elements in all of several views, FIG. 1 through FIG. 3 illustrate protective headgear 2 that addresses the need for protective headgear for Western style equestrian riders. The protective headgear 2 includes hat 4 having continuous lower brim 6 and dome 8. Continuous lower brim 6 includes a front portion 32 opposite a rear portion 34 that define a longitudinal direction therebetween. Longitudinal direction extending between front portion 32 and rear portion 34 lies coplanar with the sagittal plane a person (i.e. wearer "W") wearing protective headgear 2. Lower brim 6 further includes a left portion 36 spaced apart and opposite a right portion 38 that define a transverse direction therebetween. The transverse direction associated with the left and right sides 36, 38 of continuous lower brim 6 are designed to be coplanar with the coronal plane of the wearer W wearing protective headgear 2. Lower brim 6 includes an outer edge 40 spaced opposite an inner edge that define a upwardly facing top surface 42 and a downwardly facing bottom surface 44. When viewed from above, outer edge 40 of lower brim 6 forms a generally curved profile and in one particular embodiment outer edge 40 is a continuous outer edge having a generally oval or generally round profile when viewed from above. Outer edge 40 of brim 6 extends 360° around an imaginary center axis 52. As is customary with many cowboy or western style hats, left portion 36 and right portion 38 may curve arcuately upward such that upwardly facing top surface 42 is generally concave along left portion 36 and along right portion 38. Similarly, downwardly facing bottom surface 44 may be convexly curved along left portion 36 and the bottom surface 44 may be convexly curved along right portion 38. Lower brim 6 is a continuous structure having a generally annular shape configured to circumscribe the head of the wearer W such that the brim 6 provides shade to the wearer's face, the wearer's left side, the wearer's right side, and the back of the wearer's neck.

The dome portion 8 has a sidewall 10 extending upward from the brim. Sidewall 10 extends from a connection with an inner annular edge 46 and extends vertically upward away from upper surface 42 towards the upwardly facing U-shaped portion 16. Sidewall 10 is generally cylindrical having a radially outwardly facing outer surface 48 opposite a radially inwardly facing inner surface 50 relative to a vertical central axis 52. Stated otherwise, sidewall 10 is aligned with the vertical central axis 52 but does not intersect the vertical axis 52 and the outer surface 48 faces away from vertical axis 52 and inner surface 50 faces vertical axis 52.

In one particular embodiment, the bottom portion of sidewall 10 meets an inner annular portion of brim 6 at inner annular edge 46 forming approximately a right angle when viewed in cross section. The crown 12 near the top of the dome forms convoluted corrugations, including the uppermost U-shaped portion 16, which is lengthwise forwardly elongated and downwardly concave, and two upwardly convex connector portions 18 and 20. It is understood that although the overall configuration of the illustrated embodiment of the hat 4 resembles that of a Stetson hat, it could be any one of a plurality of configurations of a traditional cowboy hat. The hat 4 can be made of any suitable hat material, including felt, cloth, fur, leather, or straw material of the type normally used in hat construction. The hat 4 can be made in exactly the same size, shape, and materials that existing traditional cowboy hats are made of. This allows the protective headgear 2 to look, fit, and feel exactly the same as traditional cowboy hats.

The external protective padding, also referred to as an annular exterior first protective member, 22 may be attached with adhesive or mechanical fasteners to the sidewall 10 of the dome 8 of hat 4. It is understood that although the illustrated embodiment of the external padding 22 is shown as a continuous annular ring covering the entire lower portion of sidewall 10, this external protective padding 22 could be made from a plurality of separate pieces. This external protective padding 22 could be made with any suitable cushioning material, such as expanded polystyrene foam or the like, preferably of suitable thickness to meet or exceed prevailing headgear certification impact requirements. The external protective padding 22 may be covered with an outer impact-resistant shell made from any suitable impact-resistant material such as molded ABS plastic or the like. The external protective padding 22 could also be covered with felt, cloth, leather, or some other decorative material. This external protective padding 22 may include cooling vent holes formed through the cushioning material and the outer impact-resistant shell.

More particularly, external protective padding 22 includes an upwardly facing top surface 54 and a radially outward facing generally planar vertical sidewall surface 56 and a rounded or chamfered edge 58 connecting the top surface 54 with radially outwardly facing vertical sidewall surface 56. Relative to other components of protective hat 4, top surface 54 is vertically lower than the U-shaped portion 16 and vertically higher than upwardly facing top surface 42 on brim 6. In some implementations, top surface 54 may be vertically higher than an apex 60 on each of the left portion 36 and right portion 38 of brim 6.

When viewing the external protective member 22 in cross section (FIG. 6), the external protective member 22 has a generally frustoconically shaped profile such that the vertically lower portion 55 of external protective member 22 has a greater diameter relative to vertical central axis 52 than the diameter associated with the external protective member 22 near the vertically uppermost portion of the external protective member 22. Stated otherwise, sidewall 22 may slightly taper from bottom to top of external protective member 22. There may be other implementations where external protective member 22 is generally orthogonal relative to the upwardly facing top surface 42 of brim 6.

Top surface 54 of external protective member 22 lies along a plane that is generally parallel to and offset above the plane associated with continuous lower brim 6 adjacent front portion 32. Top surface 54 may be bound by an inner edge 62 and an outer edge 64 which defines an upper portion of chamfer 58. Note, instead of a chamfered edge 58, the edge may be rounded. Top surface 54 adjoins sidewall 10 at inner edge 62 and in one particular embodiment an obtuse angle defined between top surface 54 and the radially outwardly facing outer surface 48 of sidewall 10. Similar to other alternative embodiments, rather than an obtuse angle, the angle extending between top surface 54 and outer surface 48 may be a right angle or even an acute angle.

Exterior protective member 22 may have a thickness measured from outer surface 56 radially inward towards vertical center axis 52 and terminating at an inner vertical surface flushly adjoining sidewall 10. This may also be referred to as the radial thickness of external protective member 22 relative to vertical axis 52. The thickness of external protective member 22 may be in a range from about 10 mm (about 0.4 inches) to about 30 mm (about 1.2 inches). More particularly, the thickness of external protective padding 22 may be in a range from about 15 mm (about 0.6 inches) to about 25 mm (about 1 inch). In one particular embodiment, the external protective padding 22 thickness is about 19 mm (about 0.75 inch).

Exterior protective member 22 generally has a thickness, as described above, that is uniform at all points circumscribing the outside of sidewall 10 on the hat. Stated otherwise, the thickness of the exterior protective member outside sidewall 10 is the same at both the forward end, the rear end, a left side, and a right side. Note that the thickness is measured at a single vertical height at all points circumscribing a wearer's head but that the slightly tapering effect of external protective member 22 may have a varying thickness from the lower portion of external protective member 22 to the uppermost portion 57 of the external protective member 22, as stated above.

Exterior protective member 22 and interior protective member 24 are preferably formed from expanded polystyrene (EPS) foam or the like. However, other materials are entirely possible that can suitably form members 22, 24, and third member 26 for sufficient impact protection, such as, die cut ethylene vinyl acetate (EVA) foam or cross-linked polyethylene (PE) foam or the like.

Figure 6:
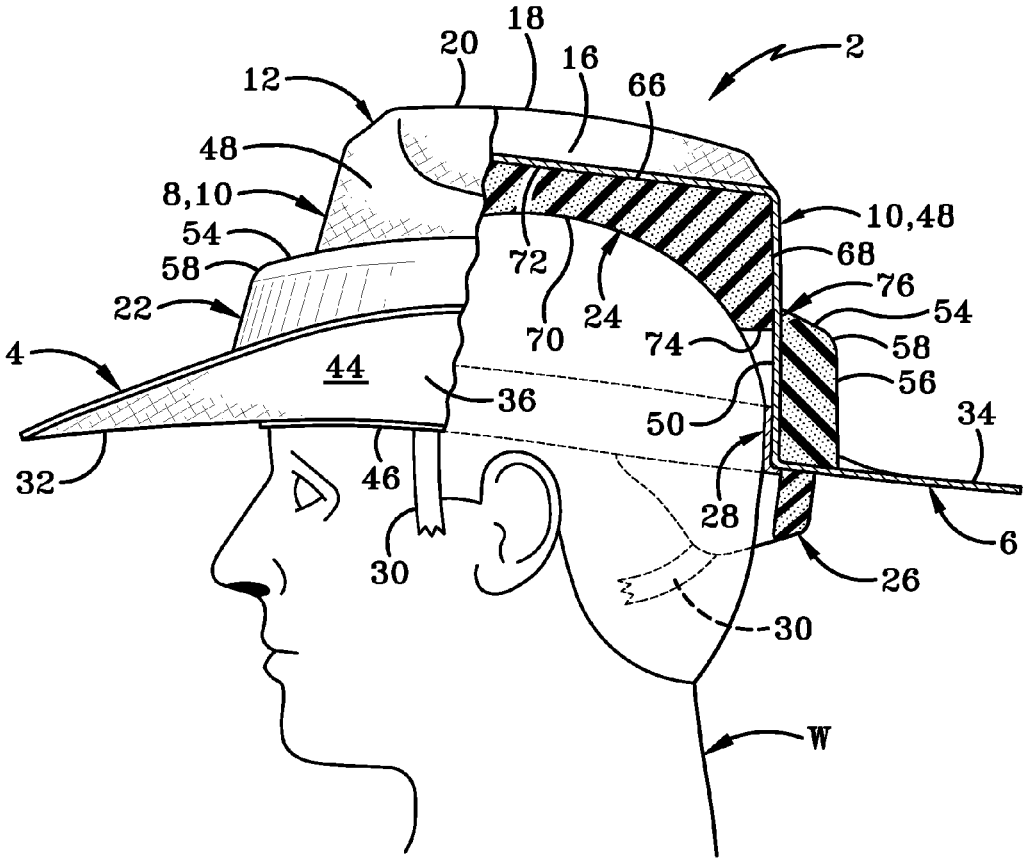
FIG. 6 is a left side elevation view depicting a partial cross-section detailing interior portions of the first embodiment.

Protective headgear 2 also includes internal protective padding, which may also be referred to as an interior second protective member 24. The internal protective padding 24 may be attached with adhesive or fasteners to the sidewall 10 or to the crown 12 of the dome 8 of hat 4 of headgear 2. It is to be understood that although the illustrated embodiment of the internal protective padding 24 is shown as a single piece filling the space between the head of the wearer W and the dome 8, as shown in FIG. 6, this internal protective padding 24 could be made from a plurality of separate pieces. This internal protective padding 24 could be made with any suitable cushioning material, such as expanded polystyrene foam or the like. The internal protective padding 24 may be covered with an impact resistant shell between the padding and the dome 8 and be made from any suitable impact-resistant material such as molded ABS plastic or the like. This internal protective padding 24 may include cooling vent holes formed through the cushioning material and the outer impact-resistant shell. The internal protective padding 24 may also have comfort padding or fabric on the bottom side of the cushioning material to provide added comfort and sweat absorption or wicking away from the wearers head.

Additionally, interior protective padding 24 includes an upwardly facing top surface 66, a generally vertical tapering sidewall 68, and a downwardly facing convex bottom surface 70. As depicted in FIG. 3, the upper portion 66 of internal protective member 24 is shaped complementary to an inner surface 72 of the uppermost U-shaped portion 16. The upper portion 66 may directly adjoin and abut against inner surface 72 of uppermost portion 16. In some embodiments, the inner member 24 may be adhered or otherwise permanently secured to the hat via adhesive adjoining the inner protective member 24 to the uppermost portion 16. The tapered sidewalls 68 of inner protective member 24 are shaped complementary to inner surface 50 of tapering sidewall 10 such that inner protective member 24 has frustoconically shaped sidewalls 68 when viewed in cross section such as depicted in FIG. 6. The downwardly facing convex bottom surface 70 is configured to receive and nest atop the wearer's W head.

Interior second protective member 24 is preferably centered along vertical axis 52 and nests within cavity defined by hat 4 in a manner such that a front portion of interior second protective member 24 aligns closely adjacent a forward portion of dome 8 and a rear portion of inner protective member 24 closely aligns with a rear portion of dome 8.

Figure 4:
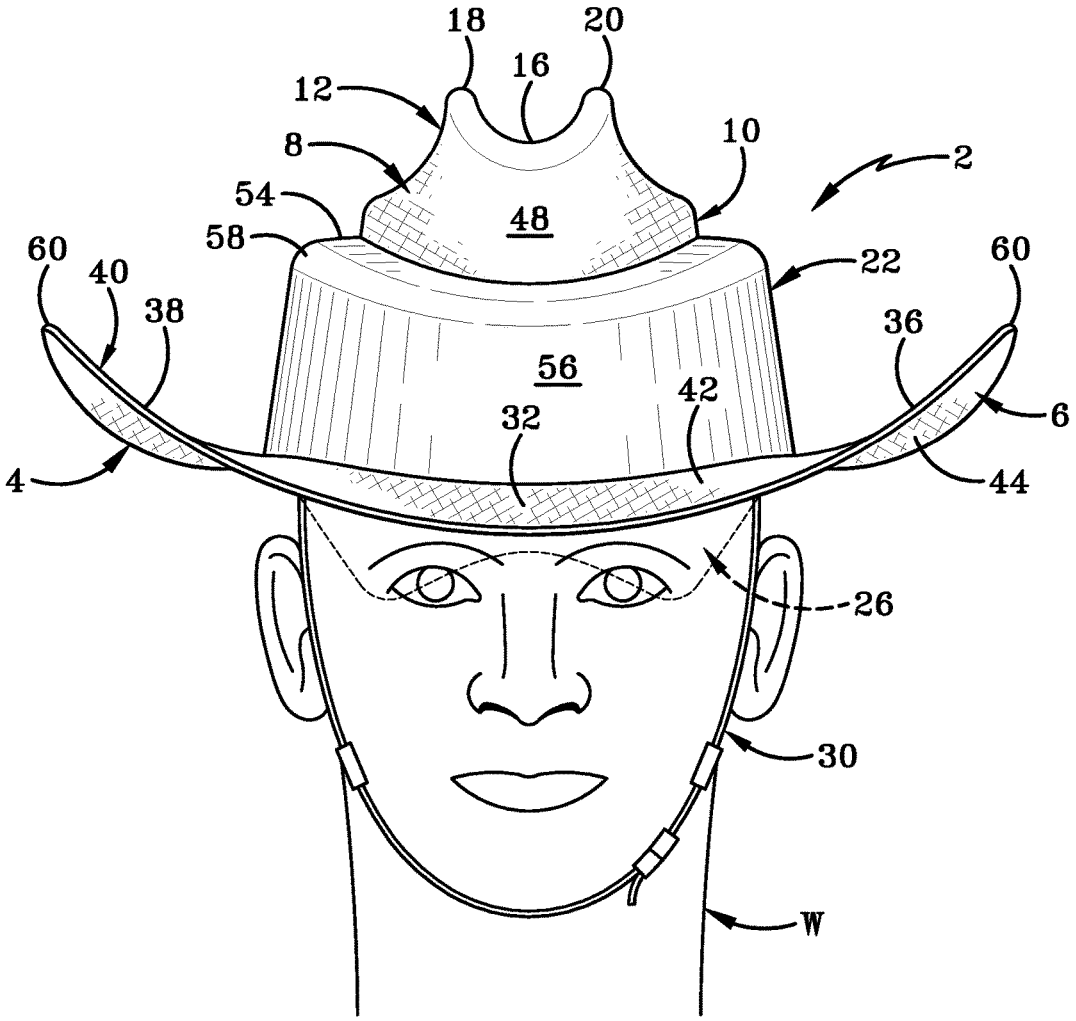
FIG. 4 is a front elevation view of the first embodiment worn by a wearer.
Figure 5:
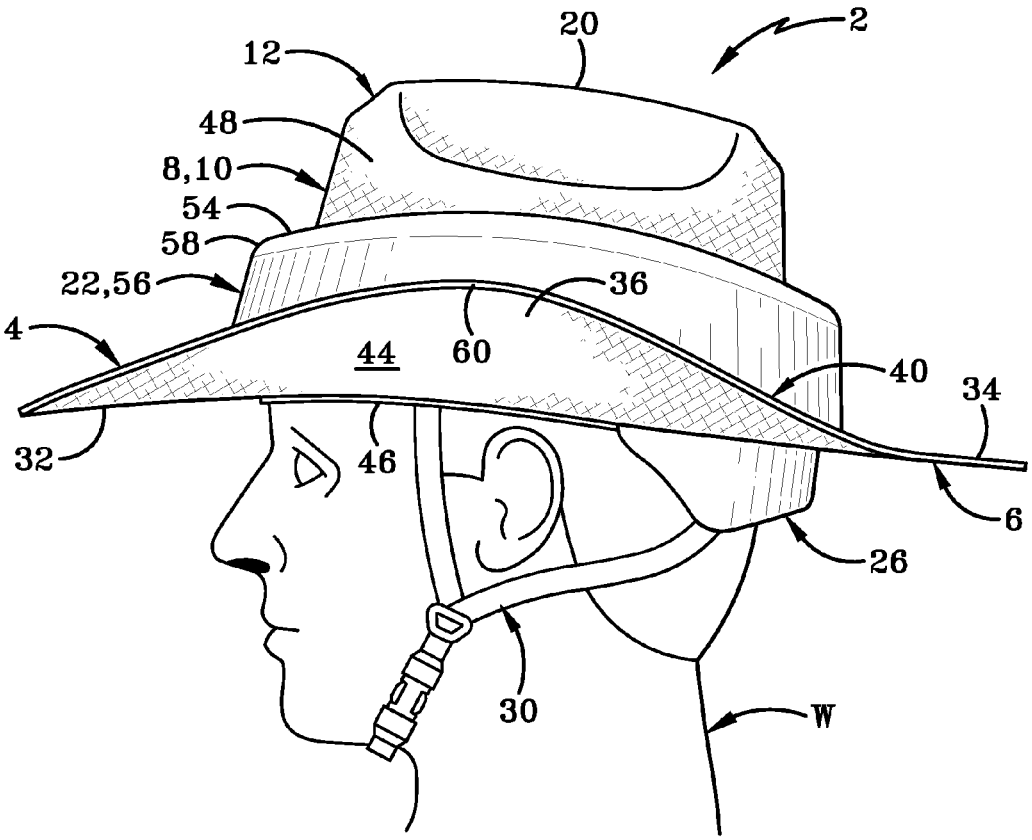
FIG. 5 is a left side elevation view of the first embodiment worn by a wearer.

FIG. 4 and FIG. 5 show the protective headgear 2 on the head of a wearer W. These views depict that the interior second protective padding 24 is not visible and the external protective padding 22 provides very little aesthetic change to the size or shape of the traditional style cowboy hat while allowing the hat to meet or exceed prevailing headgear certification impact requirements As shown in the partial cross-section view of FIG. 6, the external protective padding 22 would overlap or come close to the internal protective padding 24 near region 76 to provide continuous protection over the entire dome 8 of hat 4. This preferably allows the conventional hat 4 to meet or exceed prevailing headgear certification impact requirements. More particularly, internal protective member 24 includes a downwardly facing bottom edge or lowermost portion 74 annularly circumscribing the wearer's head defining a lowermost end of internal protective member 24. The lowermost portion 74 of internal protective member 24 terminates at a vertical height closely adjacent top surface 54 of external protective member 22. This may be referred to as a protective transition region 76. The general protective transition region 76 may have a slight vertical overlap in relative height where the upper top surface 54 of external member 22 is slightly vertically higher than the lowermost portion 74 of internal protective member 24. In some other embodiments, the lowermost portion 74 of internal protective member 24 may be at a vertically equal height with the upper top surface 54 of external protective member 22. Lowermost portion 74 is disposed on an opposite side of vertical sidewall 10 than top surface 54 of external protective member 22. Lowermost portion 74 is closer to the vertically extending center axis 52 than the upper top portion 54 which is radially farther away from center axis 52.

With continued reference to FIG. 6, bottom edge 74, which also may be referred to as the lowermost portion 74 of interior protective member 24, has a thickness that is generally uniform at all points circumscribing the wearer's head. Additionally, edge 74 terminates vertically above the upwardly facing top surface 42 of brim 6.

The protective headgear 2 may include a rear protective pad, also referred to as a third protective member 26 located below the brim 6 of hat 4 to add additional protection. The rear protective pad 26 could be made with any suitable cushioning material, such as expanded polystyrene foam. The rear protective padding 26 may be covered with an outer impact-resistant shell made from any suitable impact-resistant material such as molded ABS plastic. It could also be covered with cloth, felt, leather, or some other decorative material. The rear protective padding 26 could be attached to the brim 6, dome 8, or head band 28 of the hat 4 by stitching, adhesive, or mechanical fasteners.

The protective hat may also include a chin strap securement system comprising mutually connectable strap-and-buckle assemblies 30 secured to the hat 4 between the head band 28 and the hat 4. Preferably, this configuration would be made with materials to allow the protective headgear 2 to meet or exceed prevailing headgear certification retention and roll off requirements.

Like traditional hats, the protective headgear 2 would be available in many sizes and styles. Typically, hat sizes range from a size 6⅝ to a size 8 which fit head circumferences from about twenty-one inches to about twenty-five and a half inches. There are a wide variety of cowboy hat styles with varying shapes of creases and dents in the dome. To reduce the number of sizes required for the external protective padding 22 and the internal protective padding 24 to fit the hat 4, the protective padding could be made from a plurality of pieces that can be adjusted during assembly to fit around and inside the dome 8 of the hat 4.

Accordingly, a protective headgear has been disclosed. Advantageously, the protective hat provides wearers with the ability to wear a traditional cowboy hat 4 with its iconic look, fit, and practical weather protection. It also has the added impact protection of a helmet certified to the ASTM/SEI equestrian standard. Western riders will now embrace the protection of a helmet to save lives and reduce injuries. No longer will helmets be abandoned by Western style riders as they continue to maintain the tradition of the West.

Figure 7:
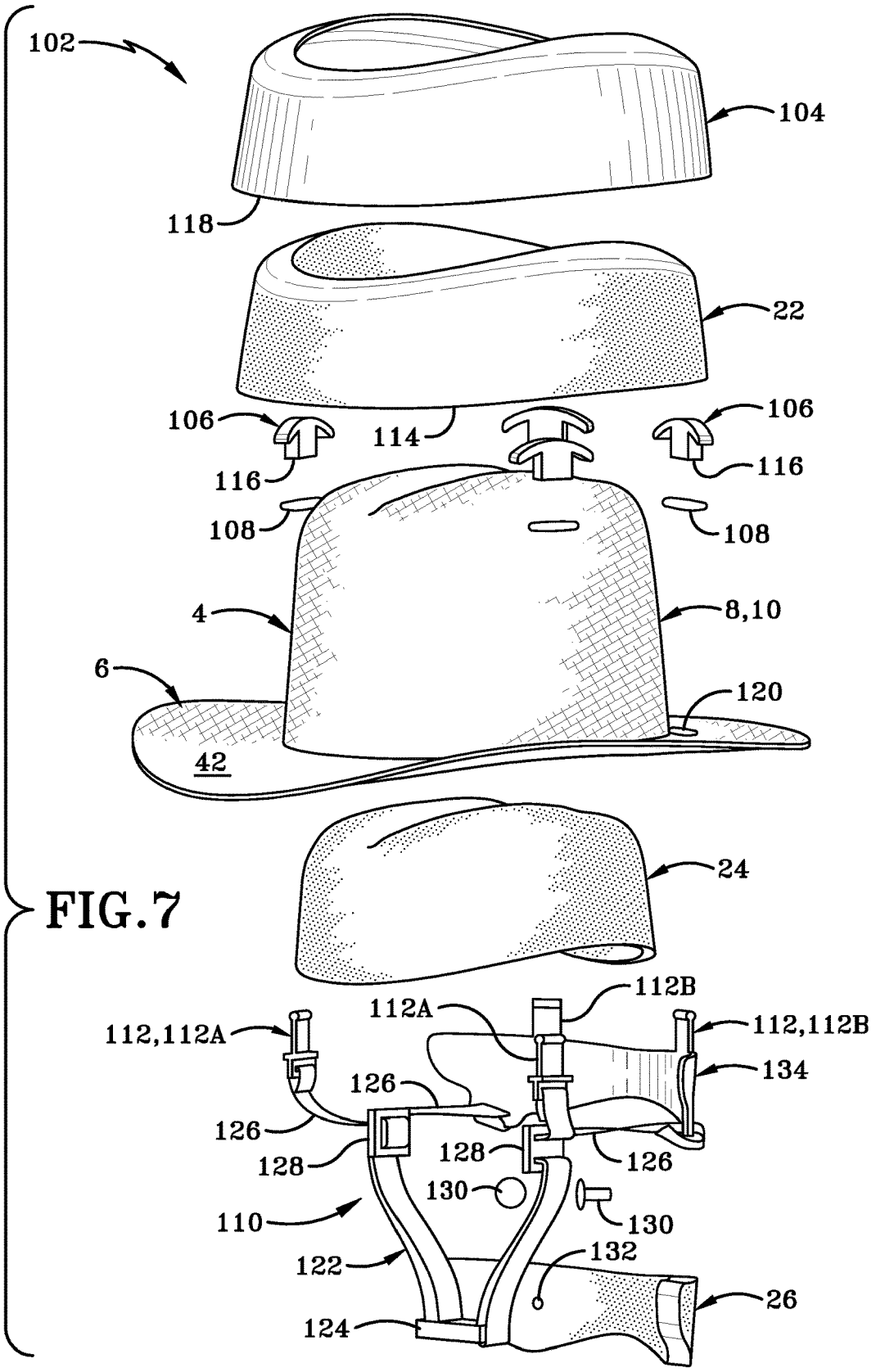
FIG. 7 is an exploded perspective view of a second embodiment.

As depicted in FIG. 7, a second embodiment of a protective headgear is shown generally as 102 in an exploded view to more completely detail the various components of headgear 102. Particularly, headgear 102 may include external first protective padding member 22, internal second protective padding member 24, a rear third protective padding member 26, hat 4, outer shell 104, a first connection member 106, a grommet 108, a strap assembly 110 having second connection members 112. The external first protective member 22 rests above brim 6 similar to that of protective headgear 2. A bottom side 114 of protective member 22 may engage the upwardly facing top surface 42 of brim 6. The first connection member 106 may be integrally formed with annular external protective member 22 such that they are recessed within the annular ring of external protective member 22 and the bottom side 116 of member 106 is flush with bottom 114. First connection members 106 define a hollow interior cavity (not shown) configured to receive second connection member 112 as will be described in greater detail below. Bottom 116 of first connection member 106 aligns with grommet 108 and aperture 120 formed in brim 6. External shell 104 surrounds and covers padding 22 and has a bottom edge 118 that lies flush with bottom edge 114 in the assembled position such that the bottom 118 of external shell 104 contacts the upwardly facing top surface 42 of brim 6. The shell 104 may be formed from an impact resistant material such as molded ABS plastic. Shell 104 may have thickness of approximately 2 mm but could be in a range from about 0.25 mm to about 4 mm. Alternatively, shell 104 may be formed from a polycarbonate vacuum formed film 0.5 mm thick.

With continued reference to FIG. 7, strap assembly 110 includes second connection members 112, a chin strap 122 having a buckle 124, and an upper portion 126 that is adjustable in length via member 128. A rear plate connector 134 connects strap assembly 110 to third protective member 26 via button connectors 130 extending through an aperture 132 formed in third member 26. More particularly, forwardmost connection members 112A are connected to upper portion 126 and rearmost second connectors 112B are part of the plate connector 134. Each of the second connection members, 112A and 112B, are inserted into first connectors 106 in the assembled position.

Figure 8:
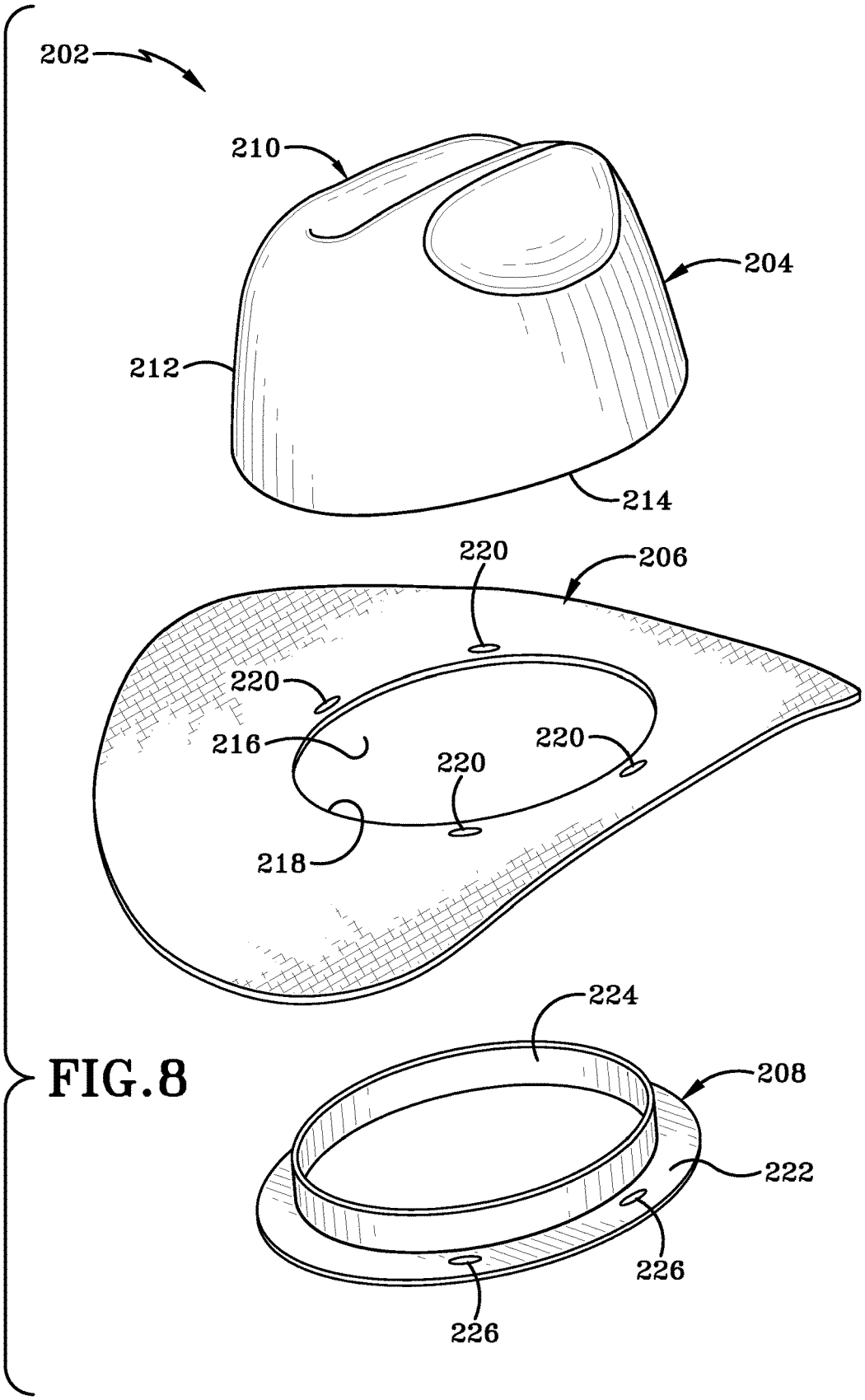
FIG. 8 is an exploded perspective view of a third embodiment.

As depicted in FIG. 8, a third embodiment of the protective headgear of the present disclosure is generally indicated at 202. Protective headgear 202 includes a protective upper portion 204, a brim 206, and a ring frame 208. Protective upper portion 204 includes an upwardly facing domed top 210 and a sidewall 212 extending downwardly therefrom to a lower generally circular or oval edge 214. Protective upper portion 204 includes a downwardly concave recessed area (not shown) configured to receive the top of the wearer's W head when third embodiment of protective headgear 202 is assembled and worn. Protective upper portion 204 may be formed of a protective material similar to that of external padding 22 and internal padding 24. Brim 206 may be formed similar to that of brim 6 defining an inner opening 216 defined by inner edge 218. External to inner edge 218 are a plurality of apertures 220 formed through the brim 206. Apertures 220 align with similar apertures (not shown) formed in the downwardly facing bottom surface adjacent bottom edge 214 of upper protective member 204.

Ring frame 208 includes horizontal leg 222 and a vertical leg 224 connecting to each other at approximately a right angle. Vertically aligned apertures 226 are formed through horizontal leg 222. In the assembled position, vertical leg 224 extends upwardly through opening 216 and into upper portion 204. The bottom surface of brim 206 engages the upwardly facing top surface of leg 222 and aperture 226 aligns with apertures with 220. Aligned apertures 220, 226 allow for the passage of a connection member, such as a screw, to connect the upper portion 204 to frame 208 sandwiching brim 206 therebetween.

FIG. 9-FIG. 12 depict a fourth embodiment of the protective headgear shown generally at 302. Some elements of protective headgear 302 include similar elements described above with respect to the first embodiment, the second embodiment, or the third embodiment. Accordingly, some elements of the fourth embodiment of the protective headgear 302 have similar reference numerals to other embodiments provided herein. It is to be understood that some components on each embodiment of the respective headgears may be interchanged or may be present on other embodiments.

Protective headgear 302 may include the hat 4, the external protective member 22, the internal protective member 24, a rear third protective member 304, an size adjustment mechanism 306, a hat band 308, anchors 310 (FIG. 11), and an insertable connector 312.

Figure 9:
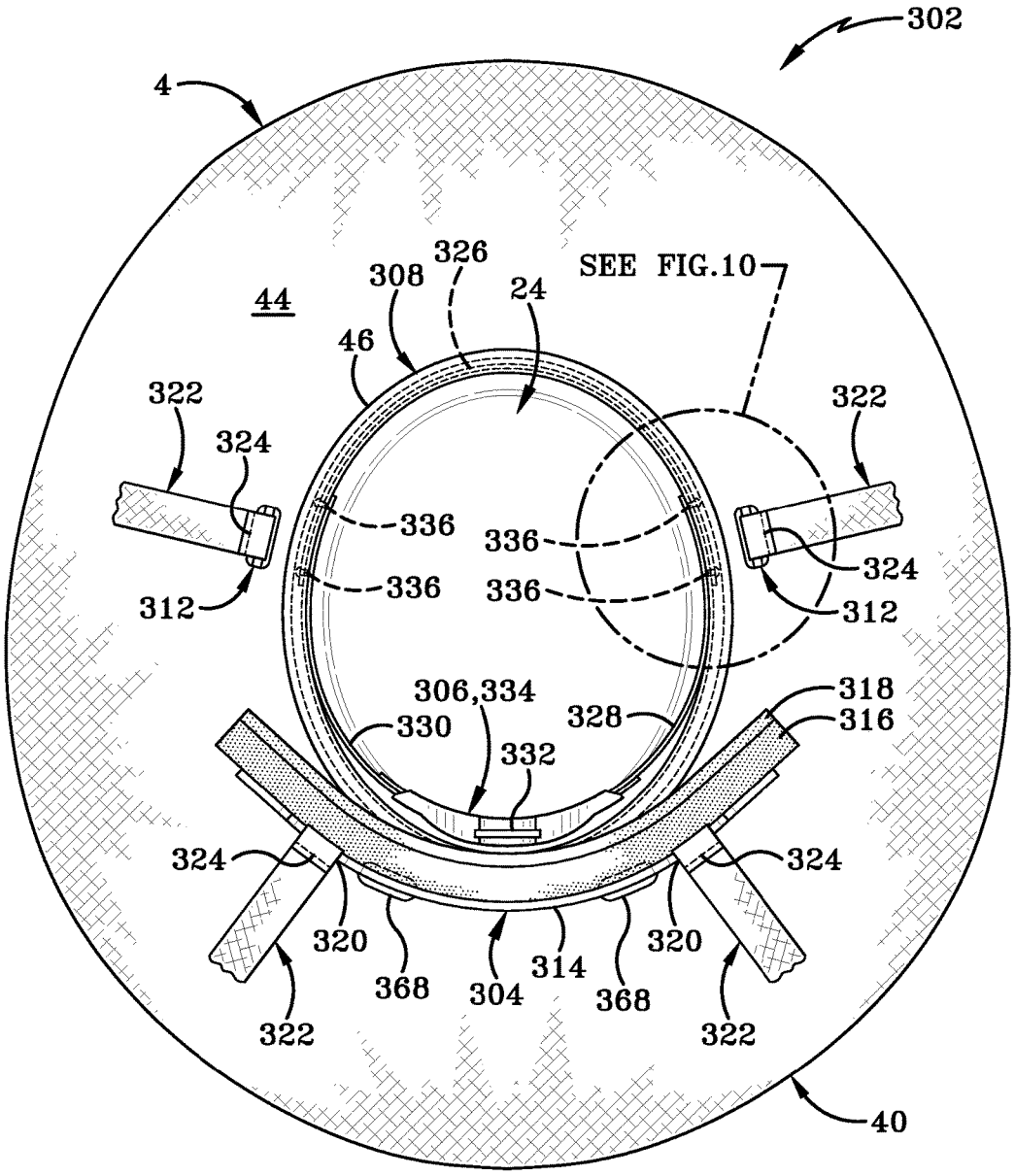
FIG. 9 is a bottom plan view of a protective headgear in accordance with the fourth embodiment of the present disclosure.

The rear protective member 304 may include a rear flange 314, a first layer of protective foam 316, and a cushion layer 318. The protective foam layer 316 is arranged intermediate the cushion layer 318 and the rear flange 314. When assembled, the rear flange 314 is positioned most rearwardly relative to the cushion layer 318. In one particular example, the rear flange 314 is formed from a hardened plastic such as an ABS material and is arcuately curved extending around the back of a wearer's head such that the rearward facing surface of the rear flange 314 is convexly curved and a forward facing surface of the rear flange 314 is concavely curved. In one particular embodiment, rear flange 314 has terminal ends on respective left and right sides that terminate more inwardly towards the central axis of the protective headgear 302 than the terminal ends of the protective foam layer 316 and the cushion layer 318. Stated otherwise, when assembled, the protective foam layer 316 may extend beyond the terminal ends of the rear flange 314. In other embodiments however, it is to be understood that the termination point of the cushion layer 318, the foam protective layer 316, and the rear flange 314 may be coplanar. As will be described in greater detail below, an upper portion of the rear flange 314 may be integrally formed with a connector, such as connector 312, which is configured to extend through the hat 4 and into an anchor 310 embedded within the first protective member 22. Moreover, a lower portion of the rear flange 314 may include a slot 320 configured to receive a strap 322 therethrough which may be looped around and sewn via seam 324 to secure strap 322 to the rear protective member 304. While sewn seam 324 is depicted in FIG. 9, it is to be understood that other methods or mechanisms for connecting strap 322 to the rear flange 314 are entirely possible. For example, other types of mechanical fasteners could be used such as grommets or rivets or other chemical mechanisms could be used such as glue or adhesive. Still further, other types of non-mechanical and non-chemical connecting means may be utilized to join strap 322 to rear flange 314.

The protective foam layer 316 may be formed of a material similar to that of the exterior first protective member 22 and the interior second protective member 24. However, in alternative embodiments, the protective foam layer 316 may be formed from a different material than that of the exterior first protective member 22 and the interior second protective member 24. The protective foam layer 316 has a thickness that can vary depending on the desired protection level of the manufacturer of the protective headgear 302. In one particular embodiment, the protective foam layer 316 is arcuately curved in a manner complementary to that of rear flange 314. Accordingly, a rear surface on protective foam layer 316 may be curved complementary to that of a forward facing surface on rear flange 314. The rear facing surface of protective foam layer 316 may be convexly curved and a forward facing surface on the protective foam layer 316 may be concavely curved. The cushion layer 318 may be adhered via adhesive or other chemical means to the forwardly facing concave surface of protective foam layer 316. Accordingly, the cushion layer 318 may be curved in a complementary manner to that of protective foam layer 316. The cushion layer 318 is configured to cushion the wearer's head against the generally rigid and protective foam layer 316. Furthermore, cushion layer 318 may have wicking properties or absorbing properties configured to remove or draw sweat or other perspiration away from the wearer's head. This is advantageous inasmuch as the protective headgear 302 may sometimes become hot when the wearer is in the protective headgear 302 for extended periods of time.

The size adjustment mechanism 306 may include a forward strap 326, a first rear strap 328, a second rear strap 330, and a rotatable wheel 332 in a housing 334. The first rear strap 328 and the second rear strap 330 are configured to pass through housing 334 and are in operative communication with wheel 332 such that rotating the wheel 332 affects movement of the first and second rear straps 328, 330. Rotatable movement of the wheel 332 in a first direction may cause the straps 328, 330 to move in a first direction and rotating the wheel 332 in an opposite second direction may cause the rear straps 328, 330 to move in a second direction. This accomplishes an adjustment of the circumference formed by the overall assembly of the size adjustment mechanism 306. Accordingly, a user or wearer may adjust the circumference of the inside of the hat in response to rotating wheel 332. Adjustment enables a user to snugly fit the protective headgear 302 to their head, which is important for providing safe protection of the rider wearing the protective headgear 302.

Figure 10:
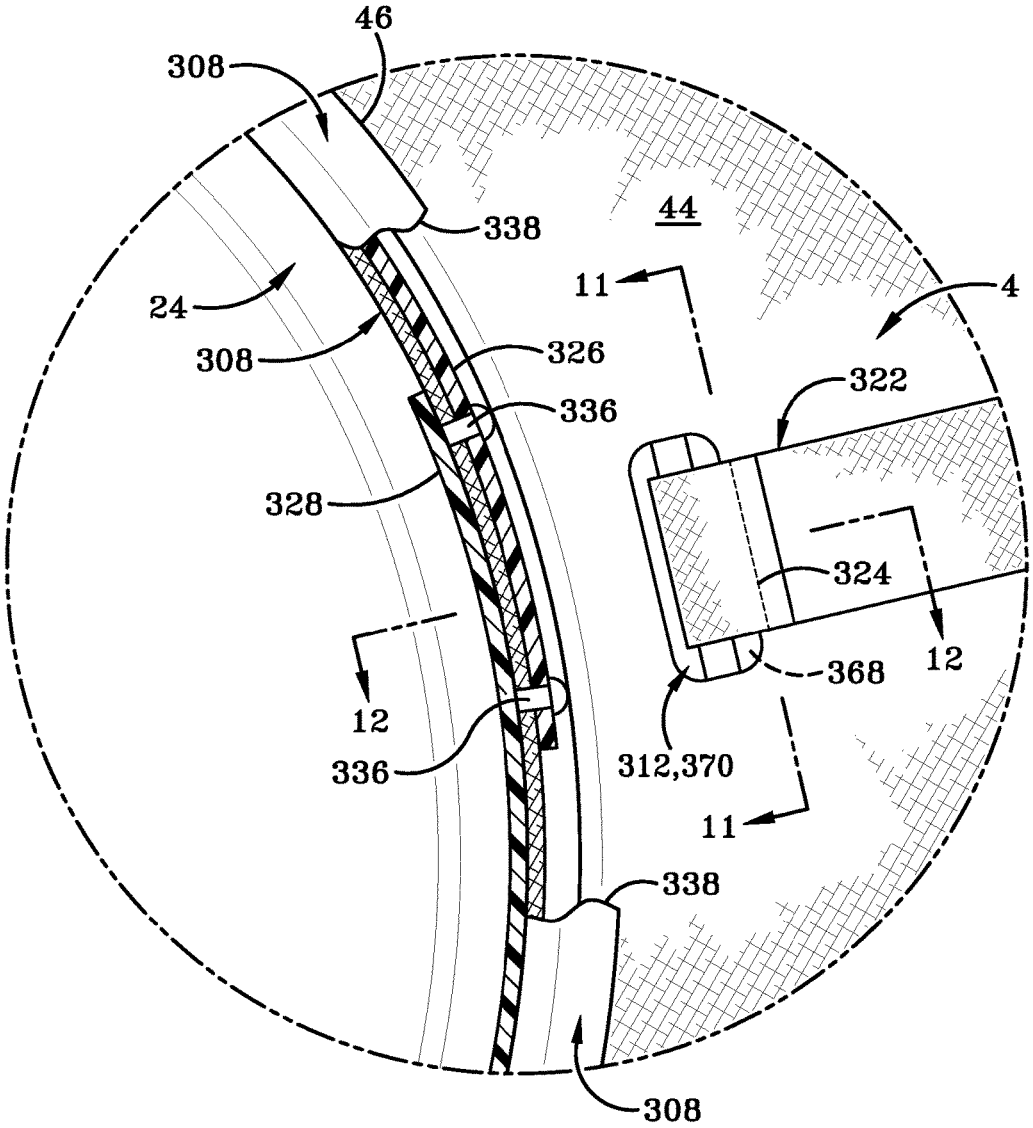
FIG. 10 is an enlarged bottom view of the region labeled "see FIG. 10" in FIG. 9.

As depicted in FIG. 10, the forward strap 326 may be connected to the first rear strap 328 via at least one pin 336 extending through the hat band 308. A portion of the hat band 308 is shown in FIG. 10 removed at breakaway line 338 to clearly depict that the forward strap 326 is located inside the hat band 308 which is foldably sewn into hat 4. The first rear strap 328 is located on an opposite side of the hat band 308 relative to the forward strap 326. While two pins 336 are shown FIG. 10, it is to be understood that any number of connecting mechanisms could be utilized to attach the first rear strap 328 to the forward strap 326. Furthermore, it may be possible to use non-mechanical connecting means, such as an adhesive or a weld, to connect the first rear strap 328 to the forward strap 326. Protective headgear 302 comprises a hat band 308, wherein a first portion of the adjustment mechanism 306 is radially interior to the hat band 308 and a second portion of the adjustment mechanism 306 is radially exterior to the hat band 308 relative to a vertical centerline. The adjustment mechanism for protective headgear 302 comprises a forward portion having a first end and a second end adapted to partially circumscribe a forward portion of a wearer's head; a first rear strap 328 adapted to partially circumscribe a rear portion of a wearer's head; a second rear strap 330 to partially circumscribe a rear portion of a wearer's head opposite the first rear strap 328; the first end of the forward portion connected to the first rear strap 328 at a first union, wherein the first end of the forward portion and the first rear strap 328 are positioned on opposite sides of an intermediate layer at the first union; and the second end of the forward portion connected to the second rear strap 330 at a second union, wherein the second end of the forward portion and the second rear strap 330 are positioned on opposite sides of the intermediate layer at the second union.

With continued reference to FIG. 9 and FIG. 10, the forward portion (i.e., forward strap 326) has a first end and a second end adapted to partially circumscribe a forward portion of a wearer's head. The first rear strap 328 partially circumscribes a rear portion of a wearer's head. The second rear strap 330 partially circumscribes a rear portion of a wearer's head opposite the first rear strap. The first end of the forward portion (i.e., the forward strap 326) is connected to the first rear strap 328 at a first union. The first end of the forward portion (i.e., the forward strap 326) and the first rear strap 328 are positioned on opposite sides of an intermediate layer (such as the hat band 308) at the first union. The second end of the forward portion (i.e., the forward strap 326) is connected to the second rear strap 330 at a second union. The second end of the forward portion (i.e., the forward strap 326) and the second rear strap 330 are positioned on opposite sides of the intermediate layer (such as the hat band 308) at the second union. In this particular example, the forward portion (i.e., the forward strap 326) is positioned between the hat band 308 and the domed hat 4. Furthermore, this embodiment may also provide wherein the adjustment mechanism includes no straps that extend upwardly over a region adapted to receive a crown of the wearer's head.

Figure 11:
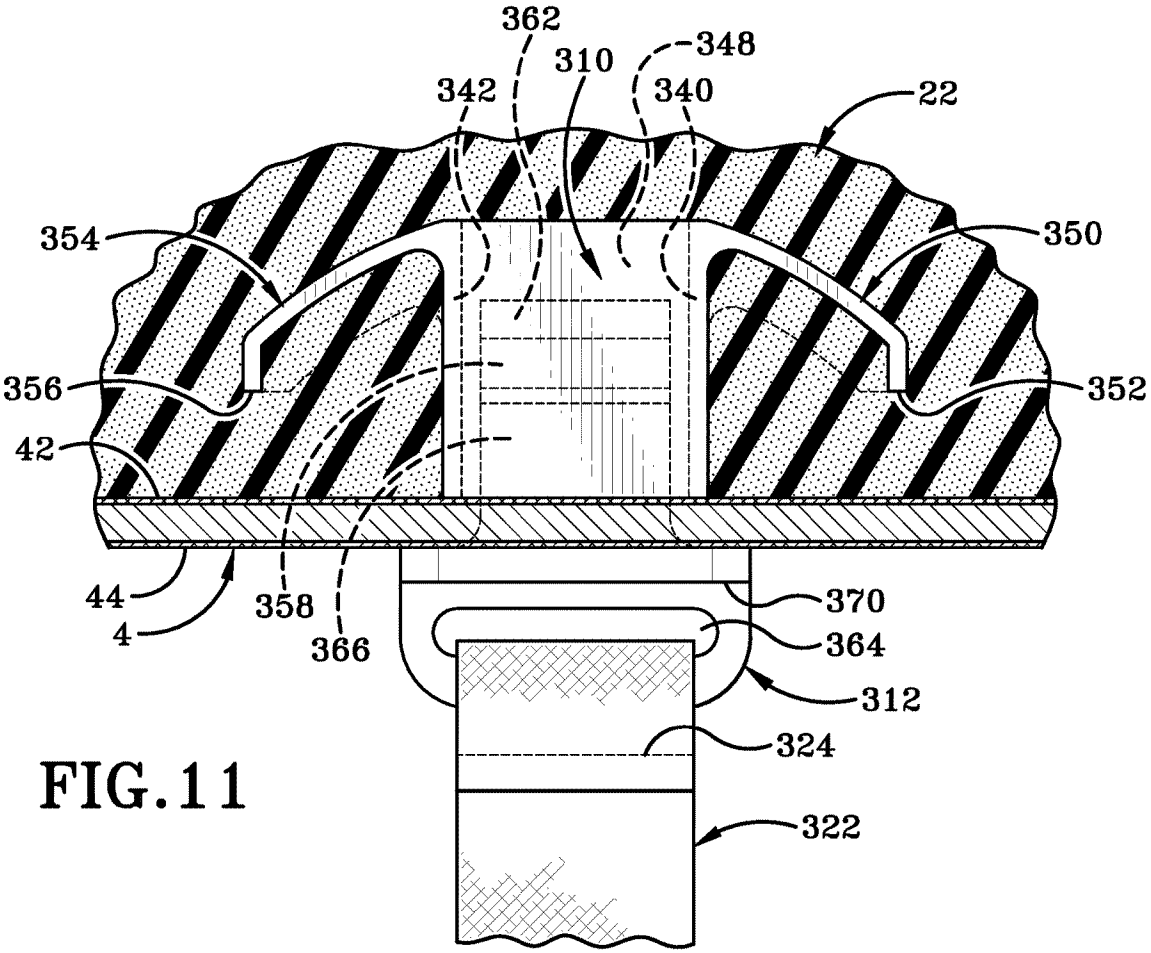
FIG. 11 is a cross section taken along line 11-11 in FIG. 10.
Figure 12:
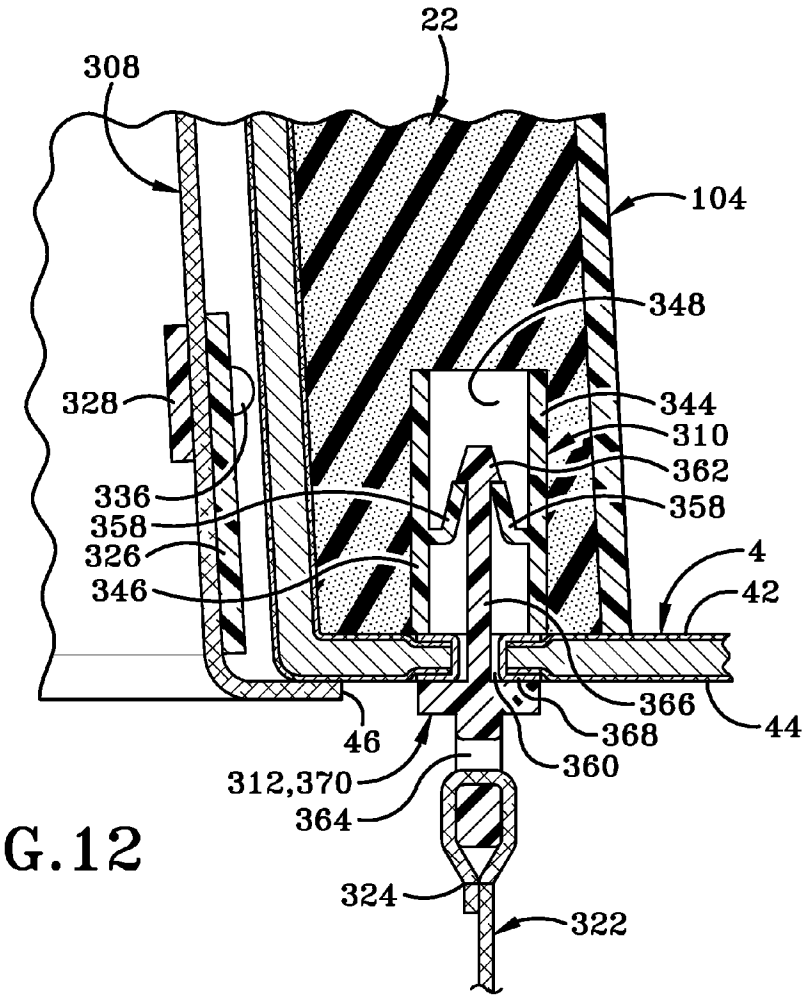
FIG. 12 is a cross section taken along line 12-12 in FIG. 10.

As depicted in FIG. 11 and FIG. 12, the anchor 310 may include a first end wall 340, a second end wall 342, a first sidewall 344, and a second sidewall 346 that are attached together to define an interior cavity or chamber 348. An anchor first arm 350 extends outwardly in a cantilevered manner from the first end wall 340 towards a terminal end 352. Terminal end 352 is angled downwardly such that the anchor first arm 350 defines a shape that inhibits or precludes movement from the anchor's 310 embedment within the first protective member 22. An anchor second arm 354 may extend in a cantilevered manner outwardly from second end wall 342 to another terminal end 356 in a downwardly angled manner to effectuate the anchor 310 being embedded within the first protective member 22.

With continued reference to FIG. 12, first and second protrusions 358 extend inwardly into the chamber 348 from respective first and second sidewalls 344, 346. The protrusions 358 are spaced apart and form generally L-shaped members that have a slight gap therebetween that are configured to receive a portion of connector 312 therethrough as will be described in greater detail below.

The cavity or chamber 348 is vertically aligned with an aperture 360 formed in hat 4. In one particular embodiment, an annular grommet or annular collar 368 may be connected with hat 4 so as to provide a structural base to contain the integrity of the aperture 360 when connector 312 is inserted therethrough as will be described in greater detail below.

With continued reference to FIG. 12, the connector 312 includes an enlarged head 362 defining a first end of the connector and an opposite second end defining a slot 364 and a generally planar body 366 extending therebetween. A retaining flange 370 may be generally transversely aligned to have a width greater than that of aperture 360 formed in hat 4 such that when the connector 312 is inserted through the aperture 360, it does not extend beyond retaining flange 370. During assembly, the enlarged head 362 moves through aperture 360 and through the gap defined between protrusions 358 inside the chamber 348 of anchor 310. The protrusions 358 flex outwardly to enable the enlarged head 362 to pass thereby and spring back into place. The protrusions 358 then engage the enlarged head 362 to prevent the connector 312 from being pulled outwardly from the chamber 348 of anchor 310. This creates a one-way connection of the connector 312 with the anchor 310. Stated otherwise, once assembled, a substantially permanent connection is established between the connector 312 and the anchor 310. Only forceful destruction of the anchor 310 or the connector 312 would effectuate their separation.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

The invention claimed is:

1. An adjustment mechanism for headgear comprising:

a forward portion having a first end and a second end adapted to partially circumscribe a forward portion of a wearer's head;

a first rear strap adapted to partially circumscribe a rear portion of a wearer's head;

a second rear strap to partially circumscribe a rear portion of a wearer's head opposite the first rear strap;

the first end of the forward portion connected to the first rear strap at a first union, wherein the first end of the forward portion and the first rear strap are positioned on opposite sides of an intermediate layer at the first union; and the second end of the forward portion connected to the second rear strap at a second union, wherein the second end of the forward portion and the second rear strap are positioned on opposite sides of the intermediate layer at the second union.

2. The adjustment mechanism for headgear of claim 1, wherein the intermediate layer is a hat band.

3. The adjustment mechanism for headgear of claim 2, further comprising a rotatable wheel configured to move the first and second rear straps in response to rotation of the wheel;

wherein the forward portion is positioned between the hat band and a domed hat.

4. The adjustment mechanism for headgear of claim 3, wherein the first rear strap and the second rear strap are positioned interior to the hat band, and further comprising:

a first connector extending through the hat band connecting the first rear strap to a first end of the forward portion; and a second connector extending through the hat band connecting the second rear strap to a second end of the forward portion.

5. The adjustment mechanism for headgear of claim 1, wherein the adjustment mechanism includes no straps that extend upwardly over a region adapted to receive a crown of the wearer's head.

6. An adjustable headgear device comprising:

a full brim on a hat simulating a western-style cowboy hat;

a domed portion extending upwardly from the full brim, the domed portion having a bottom edge defining a circumference, the domed portion adapted to receive a wearer's head;

a hat band interior to the domed portion near the bottom edge, the hat band extending around at least a majority of the circumference of the bottom edge;

an adjustment mechanism including a forward portion, a first rear strap, a second rear strap, and a rotatable wheel configured to move the first and second rear straps in response to rotation of the wheel;

wherein the forward portion is positioned between the hat band and the domed portion;

wherein the first rear strap and the second rear strap are positioned interior to the hat band;

a first protective member exterior to the domed portion, wherein the protective member is annularly shaped and fully circumscribes the domed portion;

a second protective member interior to the domed portion positioned above the hat band and the adjustment mechanism;

a third protective member extending downwardly from the full brim; and a strap assembly connected to the first protective member via anchors embedded in the first protective member, wherein a portion of the strap assembly extends through the full brim.

* * * * *